United States Patent [19]

Koenig et al.

[11] Patent Number: 4,750,188

[45] Date of Patent: Jun. 7, 1988

[54] ELECTRODE ARRANGEMENT FOR ELECTROARC OR REDUCING FURNACES

[75] Inventors: Heribert Koenig, Duisburg; Heinz Stark, Essen, both of Fed. Rep. of Germany

[73] Assignee: Mannesmann AG, Duesseldorf, Fed. Rep. of Germany

[21] Appl. No.: 88,864

[22] Filed: Aug. 24, 1987

[30] Foreign Application Priority Data

Sep. 8, 1986 [DE] Fed. Rep. of Germany ..... 3630861

[51] Int. Cl.[4] ..... H05B 7/12

[52] U.S. Cl. ..... 373/96; 373/101

[58] Field of Search ..... 373/96, 101, 100, 94

[56] References Cited

U.S. PATENT DOCUMENTS

| | | | |
|---|---|---|---|
| 4,458,352 | 7/1984 | Tuovinen et al. | 373/101 |
| 4,490,825 | 12/1984 | Persson | 373/96 |
| 4,587,659 | 5/1986 | Ungar et al. | 373/96 |
| 4,653,067 | 3/1987 | Koenig et al. | 373/101 |

*Primary Examiner*—Roy N. Envall, Jr.

*Attorney, Agent, or Firm*—Ralf H. Siegemund

[57] ABSTRACT

An electrode arrangement for passing into an electroarc or reducing furnace includes a plurality of cooling jacket capsules each surrounding an electrode and having at least two longitudinal openings each of angular width about 40 degrees; wearproofed current feeders are inserted, possibly insulatively embedded in the openings; one of the openings of each capsule facing the opening of another of the capsules.

9 Claims, 3 Drawing Sheets

(E-E)

(A-A)

(C)

ELECTRODE ARRANGEMENT FOR ELECTROARC OR REDUCING FURNACES

BACKGROUND OF THE INVENTION

The present invention relates to fittings for electrodes to be used in electroarc furnaces or reducing furnaces. Such furnaces usually have a particular lid or cover and the electrodes are to be run through that cover. Concentrical to each of the electrodes are sleeves or the like cooperating with contact brackets of tubular configuration.

German patent No. 21 25 773 discloses electrode fittings of the type to which the invention pertains showing that the current feed elements in the range and vicinity of the furnace itself are protected through coaxially arranged cooling jackets. The current conductors are arranged around the electrode between the cooling jacket and that electrode. The capsulelike cooling jackets are penetrated by the magnetic field surrounding the various current feed conductors. Therefore, a high voltage is set up in these capsules. In cases the insulative - galvanic separation of the capsule from the furnace lid is actually crossed over and an electric current will flow in the capsule in the direction opposite the current flow in the current tubes. That current of the capsules induces a current in the lid or cover. Therefore the cover is inductively heated.

In summary, the known device exhibits inductive heating of the cover which is a drawback. Moreover, there may be sparks and local burning of the cover even if a high current flow only for a relatively short period of time. Another drawback is that owing to these losses there is a higher inductive nonohmic i.e. wattless resistance which in turn requires a higher power rating for the furnace transformer as well as for the conductors leading to and from the transformer.

DESCRIPTION OF THE INVENTION

It is an object of the present invention to provide a new and improved current feeding of the type mentioned above which even though rather simply constructed exhibits a long use life and reduced reactance.

It is a particular object of the present invention to provide a new and improved feed through for electrodes in electric arc and reaction furnaces which include a cover passed through by one or more electrodes, each electrode being connected to current feeders adjacent to the bottom end of the respective electrode.

In accordance with the preferred embodiment of the present invention, it is suggested to provide cooling jacket capsules with at least two longitudinal openings or perforations extending over circumferential angle of about 40 degrees as far as width is concerned. These apertures are receive the current feed pieces being arranged coaxial to the capsules and openings of respective two adjacent jackets face each other.

The length of each opening is limited by ring elements to define a width-to-weight ratio of 0.05 to 0.2, the width being that of the ring, the height being the spacing of the capsule from the furnace bottom. The angular width of the openings are larger at least than the sum total of the diameter of current feed lines (tubes). The current feed lines being being are separated from the edge of the openings by space that is lined, even filled by insulation e.g. a ceramic material. The current feeder lines in the openings are covered by a wear proofing material e.g brass. The current feeder lines e.g. tubes run basically axially along respective electrodes and in the range of connection to the electrode these conductors run annularly around the electrode.

The advantage offered by the invention is to be seen in that the particular arrangement of the current feeders and the association of the respective conductors receiving openings of the jacket one obtains at least a partial compensation of the magnetic fields of adjacent electrode feeders so that on account of the losses and field strength in and between the various phases e.g. of a 3-phase arc furnace are drastically reduced and inductive heating of the lid is reduced accordingly while on the other hand there is a lower overall reactance of the electrode plus current feeder structure as in known systems.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a cross section through three electrodes 14 of an electric arc furnace 10 being supplied with 3-phase current. The electrodes 14 each are surrounded by a capsule or sleeve 30. Each capsule 30 being a cooling jacket in each instance is provided with two openings 34 and 35 each being 40 degrees wide (angle width W—FIG. 3). The opening 34 of one capsule faces an opening 35 pertaining to an adjacent electrode and capsule. A system of current feed tubes 20 and 21 are provided in and along the cooling space. The tubes 21 each have portions 22 being arranged in the openings 34 and 35. These tubes or tube pieces 22, are in this particular area, surrounded by a wearproofing cover 42 made e.g. of brass. The wearproofing is shown in FIG. 3. An electric insulation 41 is put between the wearproofing 42 and the jacket of the capsule 30. The insulation covers an edge of an opening and is made of ceramic material.

FIG. 2 shows the section A-A of FIG. 1 and here particularly a pair of openings 34 and 35 face each other are limited by the upper capsule ring element 32 as well as to a lower ring capsule element 33. The opening is thus limited to a longitudinal extension L. The ring element 32 and 33 have an axial width B. The capsule has a height H measured in axial direction from the furnace bottom. The diameter of the current feeder tubes is designated by D.

Figure 1:
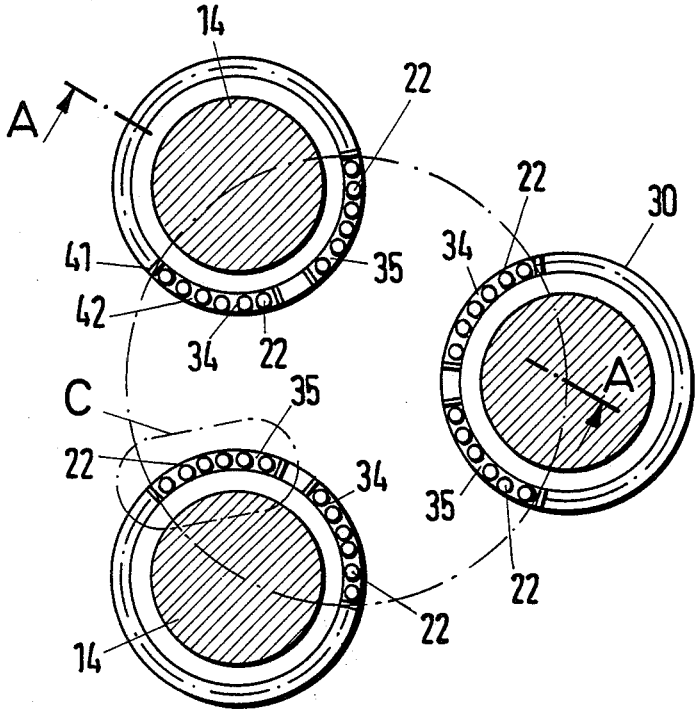
FIG. 1 is a horizontal section through an electrode arrangement for a 3-phase current feed system in the level of a section plane E—E so indicated in FIG. 2.
Figure 2:
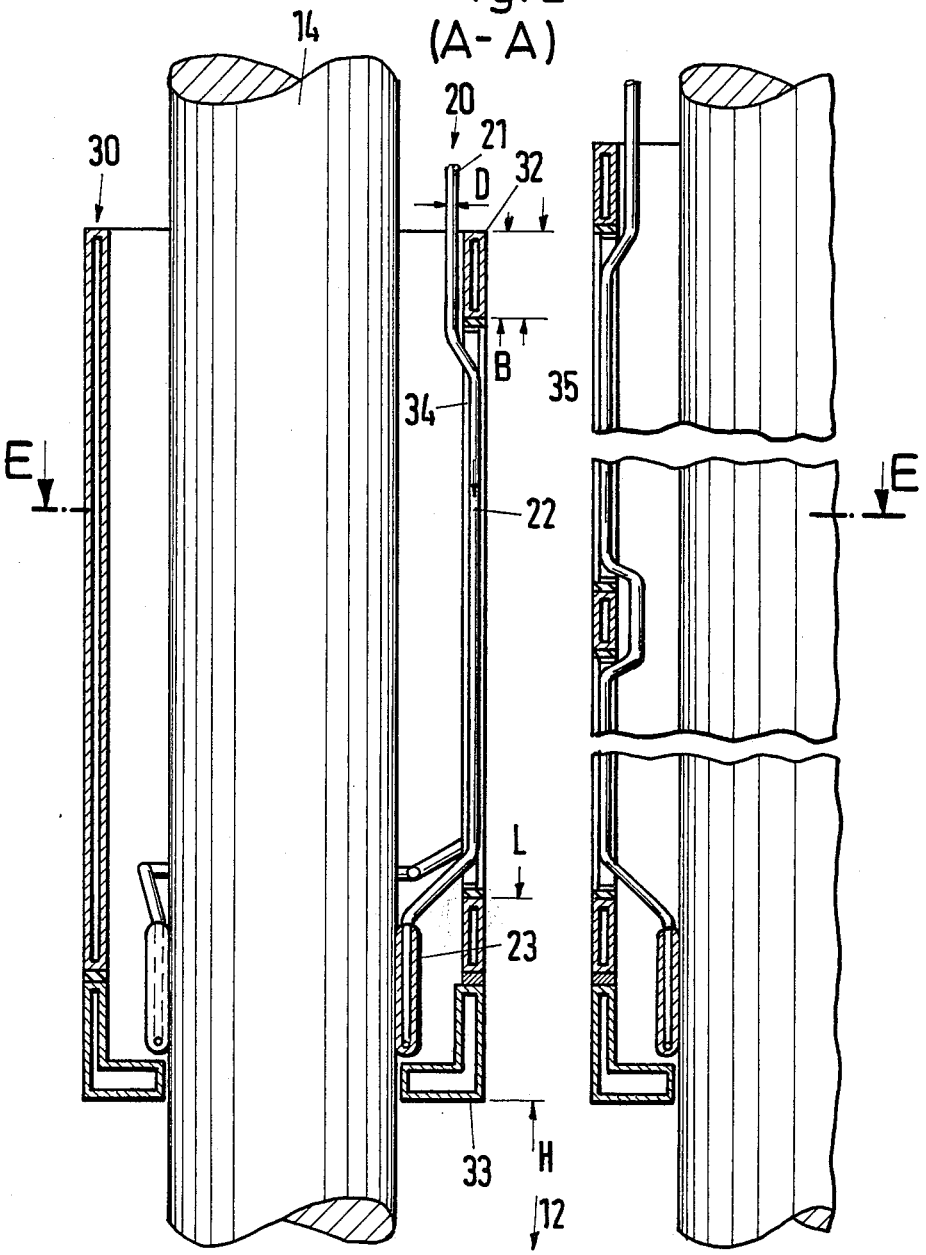
FIG. 2 is a section along line A—A in FIG. 1.

The current feed tubes 21 are run from contact making brackets 23 or the lower end of each other and as a group coaxial to the electrode 1 in direction away from the furnace. The arrangement of the tubes 21 in the area of the contact bracket is shown in detail in FIG. 3. These current feed tubes 21 are run from the lower capsule element 33 up and following a radial outward jump or step away from the electrode and from there they are run and extend in the openings 34, or 35 as the case may be, until they reach a position below the upper capsule ring element 32. Following that point the current feed tubes 21 run radially back to where the electrode and above the uppermost capsule ring element 32 and the electrode 14, to reach a position above the lid or cover of the furnace; the position being axis parallel to the electrode 14.

Depending upon the length of the electrodes one could provide additional openings such as 34 and 35 above the capsule ring element for further positioning of the current feed tubes 21 otherwise following the principles of construction as described so far. Outside the openings 34 and 35 capsule 30 is retained in its original tubular or sleevelike shape all along the edges (above, below and along) the side and configurations. The openings 34 and 35 are provided with insulation pieces 41 made of ceramic. These pieces separate the current feed tubes and surrounding metallic protection elements 42 from the remainder of the furnace. The separation is such that no direction current can flow. The wearproofing could in effect be a ceramic material which embeds the tubes 2 or tube portions 22 and occupies the entire space of the opening 34 and 35 not occupied by the tubes 22.

Figure 3:
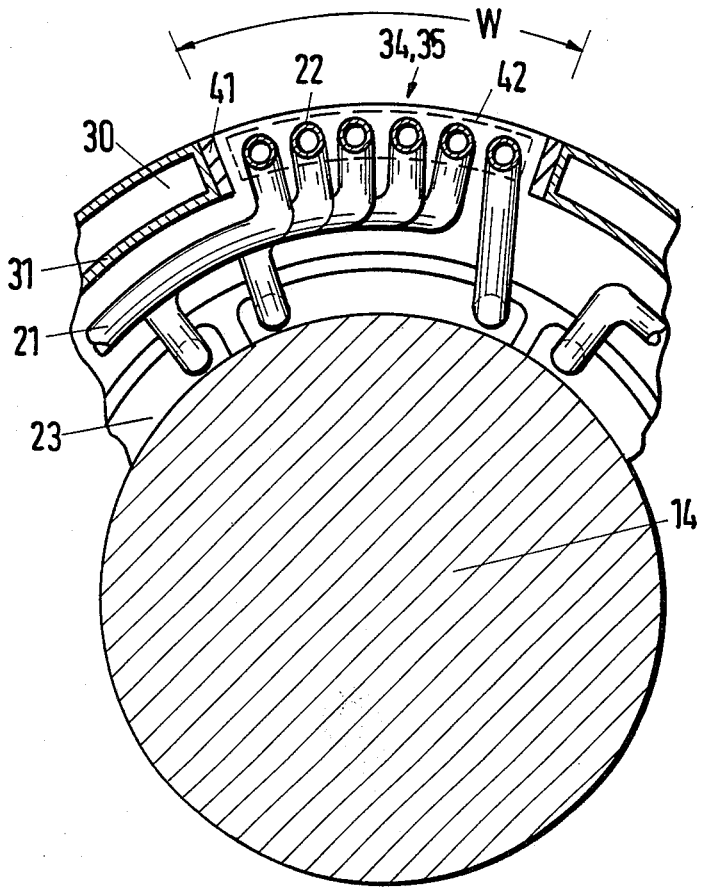
FIG. 3 is an enlarged and detailed view of portion C in FIG. 1.

FIG. 3 illustrates view C of FIG. 1 showing particularly that the capsule 30 is interrupted over the width W within any of the jacket openings 34 and 35. Tubular current feeders 21 have sections or sleeve portions 22 arranged in the openings 34 and 35. The insulation pieces 41 mentioned earlier are arranged between the tubes 21 and the edges of the openings in capsule 30. The tubes themselves or a portion 22 may be provided with a metallic protection and directly or indirectly is surrounded by wearproofing lining 42. This lining may be deposited in some fashion or in a shield-like fashion or it is a cast piece e.g. brass received by the respective tube. The tubes 21 run azimuthally around the electrodes 14 in the area of the contact brackets leading to the individual brackets 23 (FIG. 3).

Certain dimensions are indicated in the drawings, width W of an opening 34, 35; height L thereof; width B of the rings 32 and elevation H above the furnace bottom 12. The ratio B:H is preferably between 0.05:0.2 and W is at least 50% larger than the sum of all tube diameters D in the respective opening.

The invention is not limited to the embodiments described above but all changes and modifications thereof, not constituting departures from the spirit and scope of the invention, are intended to be included.

We claim:

1. Electrode arrangement for passing into an electroarc or reducing furnace, comprising:
   - a plurality of cooling jacket capsules each having at least two longitudinal openings each of angular width about 40 degrees;
   - current feeders inserted in said openings;
   - an electrode in each of the capsules;
   - the current feeders being connected to the respective electrode; and
   - one of the openings of each capsule facing the opening of another of the capsules.

2. Electrode arrangement as in claim 1, the openings being limited by rings.

3. Electrode arrangement as in claim 2, the rings having a width (in axial direction of the electrode) that is about 0.05 to 0.2 of the height and elevation level value of the capsule above the furnace bottom.

4. Electrode arrangement as in claim 1, the current feeders in an opening having a diameter and number so that the width of the opening is 50% larger than the sum total of the diameters of the feeders in the respective opening.

5. Electrode arrangement as in claim 1, there being an insulator provided for separating the feeders from the capsules.

6. Electrode arrangement as in claim 5, the insulator being a ceramic material.

7. Electrode arrangement as in claim 1 including means for wearproofing the feeders.

8. Electrode arrangement as in claim 7, the wearproofing being made of brass.

9. Electrode arrangement as in claim 1, the feeders running annularly in an area below the respective opening to a point of connection to the electrode.

* * * * *